United States Patent [19]

Rutter

[11] Patent Number: 4,558,848

[45] Date of Patent: Dec. 17, 1985

[54] JACK ADAPTER

[75] Inventor: Thomas M. Rutter, Elkhart, Ind.

[73] Assignee: Fab-Form Products, Inc., Elkhart, Ind.

[21] Appl. No.: 624,401

[22] Filed: Jun. 25, 1984

[51] Int. Cl.[4] ..... B66F 3/36

[52] U.S. Cl. ..... 254/100; 254/133 R

[58] Field of Search ..... 254/133, 134, 100, 98, 254/DIG. 4

[56] References Cited

U.S. PATENT DOCUMENTS

| | | | |
|---|---|---|---|
| 2,618,464 | 11/1952 | Sintz | 254/134 |
| 2,903,258 | 9/1959 | Jovanovich | 254/134 |
| 3,984,732 | 10/1976 | Podrecca | 254/100 |

*Primary Examiner*—Robert C. Watson

*Attorney, Agent, or Firm*—Price, Heneveld, Huizenga & Cooper

[57] ABSTRACT

A jack adapter of the present invention includes a generally cylindrical solid rod having a recess formed in one end for indexing the end to a jack centering projection of a vehicle and an axially extending threaded aperture formed in an opposite end. The rod has a length selected to extend at least the distance between the jack support surface and the lower surface of an accessory running board mounted to the vehicle and a threaded fastener is employed for securing the rod to the accessory jack for the vehicle.

7 Claims, 4 Drawing Figures

JACK ADAPTER

BACKGROUND OF THE INVENTION

The present invention relates to an adapter for a jack, and particularly one which enables the jack to be used in connection with vehicles having running boards.

In recent years, converted vans have become popular vehicles and frequently include extruded aluminum running boards both for enhancing the appearance of the vehicle and for providing practical utility in ingress and egress. Recently, a mini-van has been introduced by Chrysler Corporation including, for example, the Dodge T-115 van. Such vans include a scissor jack for elevating the individual wheels for changing tires, and in this particular model, the chassis includes a jack centering projection under the rocker panels near each of the wheels. The scissor-type jack has an elevated support platform with a centering aperture for indexing with the jack centering projection for use of the jack when necessary for wheel removal.

When, however, a running board is installed as an accessory to the vehicle, access to the jack centering projection and the jack support area is blocked. The extruded aluminum running board, although structurally rigid for normal running board use, is not sufficiently strong for elevation of the vehicle, and thus, the jack cannot be used for elevating the wheels. Accordingly, either a different jack must be used, or it has to be used in an area on the vehicle not suited for such purpose.

SUMMARY OF THE PRESENT INVENTION

The system of the present invention overcomes the problem by providing an adapter which can be mounted to the accessory scissor jack provided with the vehicle without modification to the jack and which will advantageously operate to raise the vehicle using the jack support location on the vehicle. The jack adapter of the present invention includes a generally cylindrical solid rod having a recess formed in one end for indexing the end to the jack centering projecton and an axially extending threaded aperture formed in an opposite end. The rod has a length selected to extend at least the distance between the jack support surface and the lower surface of an accessory running board mounted to the vehicle and a threaded fastener is employed for securing the rod to the existent jack.

The running board includes an aperture aligned below the jack centering projection of the vehicle and having a diameter sufficient to allow the rod to extend therethrough. When the jack is not in use a removable cap is provided for covering the running board aperture.

With such a system, therefore, the existent accessory jack can be usd in elevating either of the wheels of such a vehicle without requiring a different jack or perhaps an unsafe use of the jack supplied with the vehicle.

These and other features, objects and advantages of the present invention will become apparent upon reading the following description thereof together with reference to the accompanying drawings in which:

DETAILED DESCRIPTION OF THE PREFERRED EMBODIMENT

Figure 4:
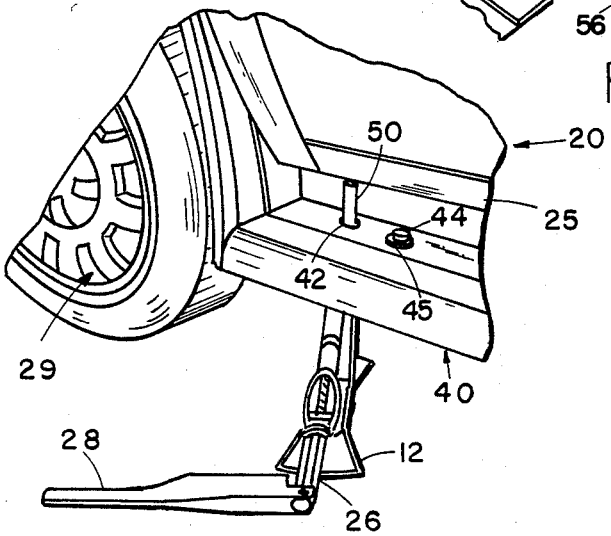
FIG. 4 is a fragmentary perspective view showing the jack and its adapter in use.

Referring to the figures, there is shown a scissor jack 10 which is standard equipment that comes with the T-115 van 20, partially shown in FIG. 4. The scissor jack includes a base plate 12, upwardly and outwardly pivoted pairs of arms 13 and 14 and inwardly and upwardly pivoted, cross-sectionally, U-shaped arm 15 and pair of arms 16 joined at a common central pivot point 17. The pairs of arms 13 and 14 have ends pivotally coupled to base 12 by pivot pins 18 and 19. The ends of arms 13 and 15 where joined are coupled by pivot pins 21 as are the ends of arms 14 and 16 at pivot pins 22. A threaded screw 24 conventionally extends through a captive coupling at the junctions of arms 13, 15 and a threaded coupling between arms 14, 16 and extends outwardly to a jack handle coupling nut 26. A socket 27 of a crank handle 28 is coupled to nut 26 for operation of the jack.

A tiltable, generally inverted U-shaped member 30 has one end pivotally coupled to the end of arms 16 by means of a pivot pin 32 and an opposite end extending over a curved end 34 at the end of arm 15. Member 30 provides a generally horizontally extending base platform for supporting a welded-on, inverted U-shaped vehicle support member 36 having a central 0.6 inch diameter aperture 38 (FIG. 3) formed therein for engaging a downwardly projecting jack centering member (not shown) integrally formed on the chassis of the van 20 under the rocker panel 25.

Thus, when the jack is employed in a standard van, the jack is raised by rotating handle 28 in a clockwise direction causing the scissor arms to move upwardly with plate 36 and aperture 38 engaging and indexed to the jack supporting area of the vehicle for raising, for example, the right wheel 29 of the vehicle. When, however, an accessory extruded aluminum running board 40 (FIG. 4) is secured under the rocker panel 25 in a conventional manner by suitable fasteners, access to the jack supporting surface of the vehicle is prevented by the intervening horizontal surface of the running board, and it is impossible to use the jack 10 for raising the wheels of the vehicle 20 using the jack supporting surface. The jack adapter 50 of the present invention, however, permits use of the jack and is now described.

Adapter 50 comprises a solid steel rod of generally cylindrical configuration having an outside diameter of 0.75 inches and an overall length of 3.5 inches in the preferred embodiment and having a convex or cup-shaped recess 52 formed in its upper end. Recess 52 has an inner diameter of 0.5 inches and a depth of approximately 0.25 inches and is formed by axially drilling the recess using a tapered bit having a 0.5 inch diameter. The opposite or lower end of adapter 50 includes a threaded aperture 54 formed upwardly on the axis of the rod forming the adapter and extending inwardly approximately 1.25 inches and having diameter of 0.5 inches to threadably receive a Class 5, 0.5 inch by 1.25 inch bolt 56.

In order to use the jack adapter of the present invention, the running board 40 includes a circular aperture 42 formed therein and located vertically under and in alignment with the jack centering projection of van 20. Aperture 42 has a diameter slightly greater than the outer diameter of adapter rod 50 such that the rod freely but closely fits through aperture 42 and when extended through the aperture aligns with the jack centering projection which extends into recess 52. The length of rod 50 is selected such that its lower end extends just below the lower surface of running board 40 such that all of the weight of the vehicle will be carried through the adapter 50 onto the jack 10 and not carried by the running board 40.

Aperture 42 can be selectively closed by a plug 44 made of a resilient polymeric material such as PVC and snap-fitted within aperture 42 when the jack is not in use. For such purpose plug 44 has a circular cap 45 and a depending cylindrical section which extends from the cap and may include a ridge spaced from the cap and slightly larger than the diameter of aperture 42 such that it snugly fits and snap-locks the plug 44 within aperture 42. The surface of the cap can be made to aesthetically conform to the running board 40.

Figure 1:
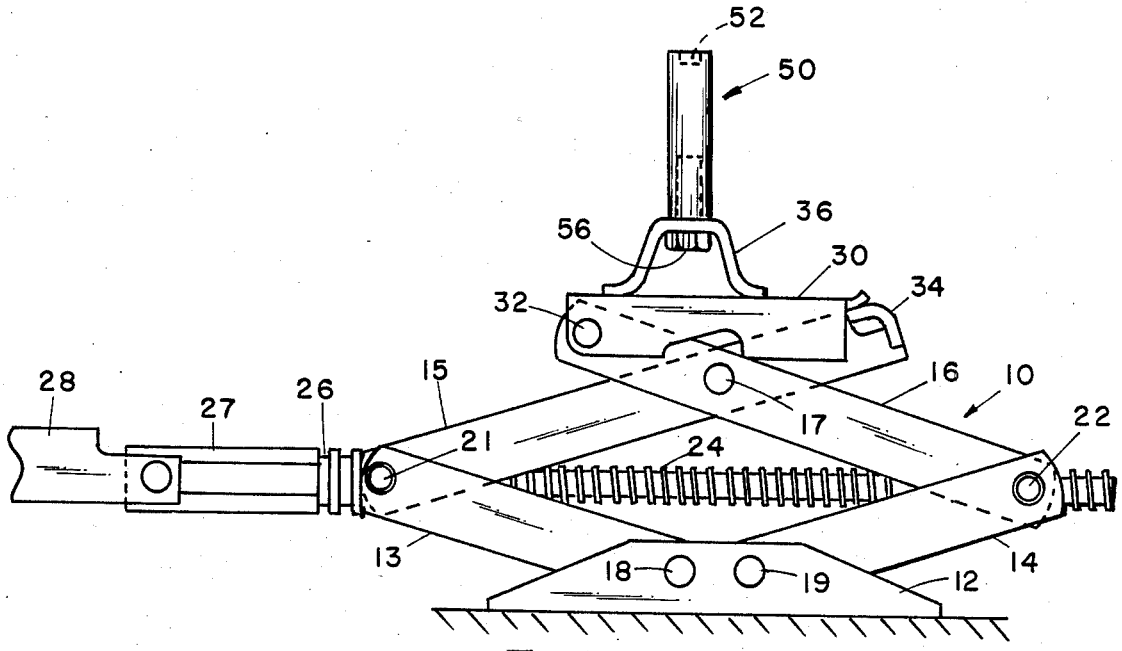
FIG. 1 is a fragmentary, right side elevational view of a jack including the adapter installed.
Figure 2:
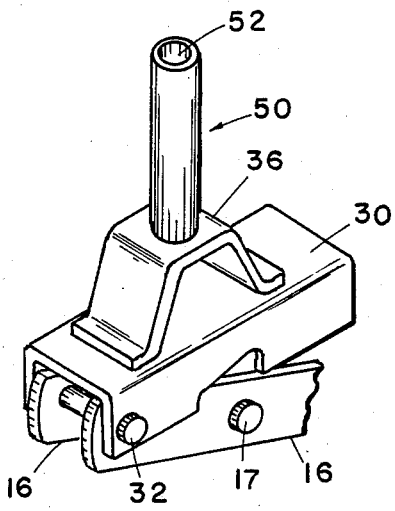
FIG. 2 is a fragmentary, perspective view of a portion of the structure shown in FIG. 1.
Figure 3:
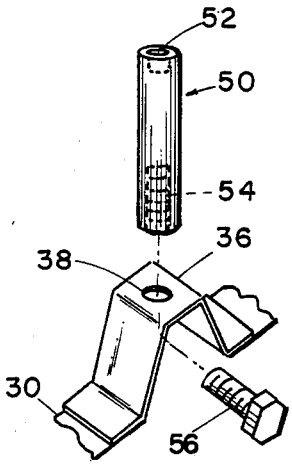
FIG. 3 is an exploded, fragmentary view of a portion of the structure shown in FIG. 2.

The adapter is installed as illustrated in FIG. 3 with the bolt 56 extended upwardly through aperture 38 in jack support plate 36 and the threaded rod 50 tightly threaded over the bolt using suitable tools. The adapater is thus removable for use of the jack for other applications. By virtue of the adapter 50, therefore, the jack is rendered operational for use with a van having running boards installed. Depending upon the particular running board, the diameter and length of the adapter 50 can be varied to assure the strength and height necessary to provide the desired operation.

These and other modifications to the preferred embodiment of the invention will, however, become apparent to those skilled in the art and will fall within the scope and spirit of the invention as defined by the appended claims.

The embodiments of the invention in which an exclusive property or privilege is claimed are defined as follows.

1. An adapter for elevating a vehicle for changing tires when said vehicle includes a running board extending between a jack supporting member and the ground comprising:

an adapter rod for extending in a generally vertical direction from a jack, said adapter rod comprising a substantially solid rod having a threaded aperture at one end; said adapter rod further including a jack support member receiving recess formed at an end opposite said threaded aperture;

means for removably securing said adapter rod to a jack comprising a bolt for extending through a support plate on a jack into said threaded aperture of said adapter rod; and a running board including aperture means formed in said running board for receiving said adapter rod, said aperture formed in vertical alignment below the jack supporting member of the vehicle whereby said adapter rod couples the jack to the jack support member through said running board.

2. The apparatus as defined in claim 1 and further including a removable plug for selectively enclosing said aperture in said running board when the jack is not in use.

3. The apparatus as defined in claim 2 wherein said adapter rod is cylindrical and has a diameter of about 0.75 inches.

4. The apparatus as defined in claim 3 wherein said adapter rod is made of steel and has a length of approximately 3.5 inches.

5. Means for elevating a vehicle for changing tires when said vehicle includes a running board extending between a jack supporting member and the ground comprising:

an adapter rod for extending in a generally vertical direction from a jack;

means for removably securing said adapter rod to a jack; and a running board including aperture means formed in said running board for receiving said adapter rod, said aperture formed in vertical alignment below the jack supporting member of the vehicle whereby said adapter rod couples the jack to the jack support member through said running board.

6. The apparatus as defined in claim 5 wherein said adapter rod is a substantially solid rod having a threaded aperture at one end and wherein said means for removably securing said adapter rod comprises a bolt for extending through a support plate on said jack into said threaded aperture of said adapter rod.

7. The apparatus as defined in claim 6 wherein said adapter rod includes a jack support member receiving recess formed at an end opposite said threaded aperture.

* * * * *